US008234984B2

(12) United States Patent
Lindskog

(10) Patent No.: US 8,234,984 B2
(45) Date of Patent: Aug. 7, 2012

(54) METHOD AND ARRANGEMENT RELATED TO A VALUE SPACE

(75) Inventor: Kjell Lindskog, Skelleftea (SE)

(73) Assignee: SQS Security Qube System AB, Skelleftea (SE)

( * ) Notice: Subject to any disclaimer, the term of this patent is extended or adjusted under 35 U.S.C. 154(b) by 0 days.

(21) Appl. No.: 12/459,771

(22) Filed: Jul. 7, 2009

(65) Prior Publication Data

US 2010/0077940 A1 Apr. 1, 2010

Related U.S. Application Data

(63) Continuation of application No. 10/512,006, filed as application No. PCT/SE03/00668 on Apr. 19, 2003, now abandoned.

(30) Foreign Application Priority Data

Apr. 20, 2002 (SE) ..... 0201192

(51) Int. Cl.
*E05G 1/00* (2006.01)

(52) U.S. Cl. ..... 109/25; 109/29; 109/31; 194/206; 209/534

(58) Field of Classification Search ..... 109/25, 109/29–34; 194/206–208; 271/216, 176; 209/534; 242/528
See application file for complete search history.

(56) References Cited

U.S. PATENT DOCUMENTS

| | | | | | |
|---|---|---|---|---|---|
| 1,266,353 | A * | 5/1918 | Trantham | 109/33 |
| 1,808,248 | A * | 6/1931 | Morssen | 109/25 |
| 4,337,864 | A * | 7/1982 | McLean | 209/534 |
| 4,513,880 | A * | 4/1985 | Mori et al. | 221/260 |
| 5,156,272 | A * | 10/1992 | Bouchard et al. | 206/459.1 |
| 5,388,433 | A * | 2/1995 | Andersson et al. | 70/57.1 |
| 5,598,793 | A * | 2/1997 | Lopez, Jr. | 109/25 |
| 5,775,235 | A * | 7/1998 | Lindskog et al. | 109/25 |
| 5,787,819 | A * | 8/1998 | Fumanelli | 109/38 |
| 6,497,186 | B1 * | 12/2002 | Lundblad | 109/25 |
| 6,553,922 | B1 * | 4/2003 | Lundblad et al. | 109/25 |
| 6,564,726 | B1 * | 5/2003 | Lindskog | 109/25 |

* cited by examiner

*Primary Examiner* — Lloyd Gall
(74) *Attorney, Agent, or Firm* — Mark P. Stone

(57) ABSTRACT

A method and an arrangement pertaining to an alarm-equipped valuable item storage space (1) includes at least one device (10-13) for the storage of valuable documents, banknotes or the like, in which a destructive agent (61) is intended to destroy the valuable documents (100) in response to a burglary attempt and/or manipulative action. In conjunction with the need to destroy the valuable documents, a destructive agent container (60,63) is opened so as to cause the destructive agent to move into a collecting vessel (50) within which a valuable document collecting device (30) is at least partially situated. The volume of a destructive agent is such as to enable the collecting vessel (50) to accommodate the destructive agent (61) in the absence of overflow. The destructive agent container (60,63) is placed above the collecting vessel (50) so that the destructive agent (61) will run or fall down into the collecting vessel when an alarm is triggered.

20 Claims, 2 Drawing Sheets

METHOD AND ARRANGEMENT RELATED TO A VALUE SPACE

CROSS-REFERENCE TO RELATED APPLICATIONS

Figure 1:
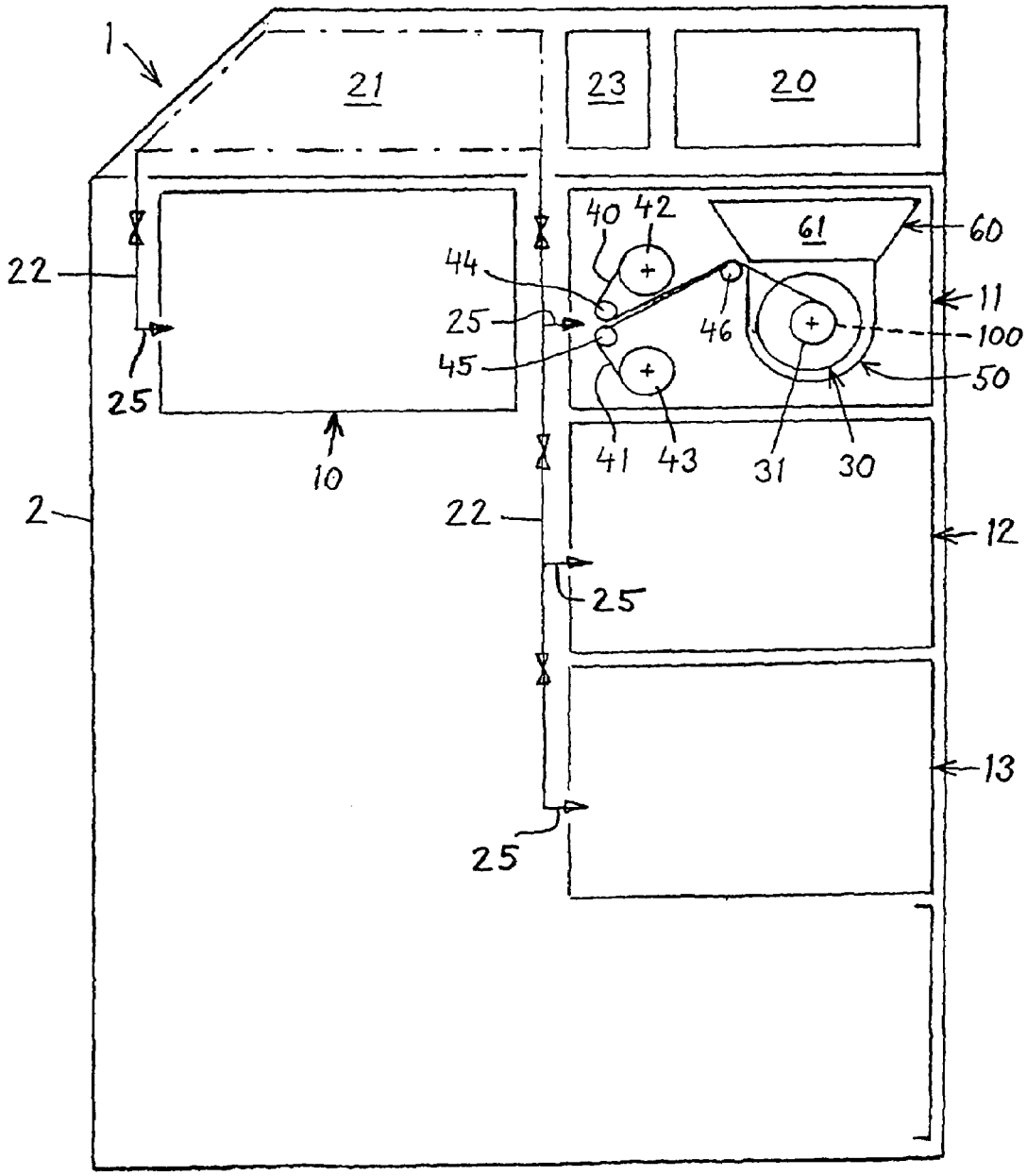

The present patent application is a continuation of, and claims the benefit of, parent patent application U.S. Ser. No. 10/512,006, filed on Apr. 20, 2005, (now abandoned) pursuant to 35 U.S.C. Section 120; said parent application claiming the benefit of International Patent Application Number PCT/SE03/00668, filed Apr. 19, 2003, pursuant to 35 U.S.C. Section 371.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable

The present invention relates to a method pertaining to a chamber or space for accommodating valuable documents. The invention also relates to an arrangement and to the use of such spaces or chambers.

BACKGROUND OF THE INVENTION

With regard to chambers or safe-storage devices that contain valuable documents in the form of banknotes, checks and other types of documents, for instance, there is a need to render the documents unusable if an attempt is made to break into the storage device. There is used to this end some kind of destructive means, for instance.

SE 514470 describes an example of a valuable item accommodating cabinet or container that includes a destructive arrangement that utilises circular recesses which are directed towards valuable documents disposed on a drum, wherein a destructive means is placed within the recesses and an explosive substance is adapted to move the destructive means in response to triggering of an alarm, so as to stain said items and render them worthless.

One problem with an arrangement of this nature is that the destructive means or the dye is distributed so aggressively as a result of the explosion as to set many of the container components at risk of being destroyed or seriously damaged, resulting in expensive repair and restoration work, among other things.

There is a great need to achieve effective staining or destruction of, e.g., drum-wound valuable documents in respect of cash dispensers, depositing machines, automatic telling machines, cash apparatus and similar devices. Destruction or staining of said items is normally initialised by some appropriate type of alarm means installed in the machine or equipment concerned.

BRIEF SUMMARY OF THE INVENTION

One object of the present invention is to provide a method and an arrangement, which will fill the aforesaid requirements to a very high degree. This object is achieved with a method and an arrangement according to the features set forth herein.

The design and construction of the inventive arrangement is such as to provide a very high degree of destruction while, at the same time, being particularly lenient with regard to surrounding components in the item accommodating space or chamber. The destructive arrangement also affords technical and economical advantages.

BRIEF DESCRIPTION OF THE SEVERAL VIEWS OF THE DRAWING(S)

Figure 2:
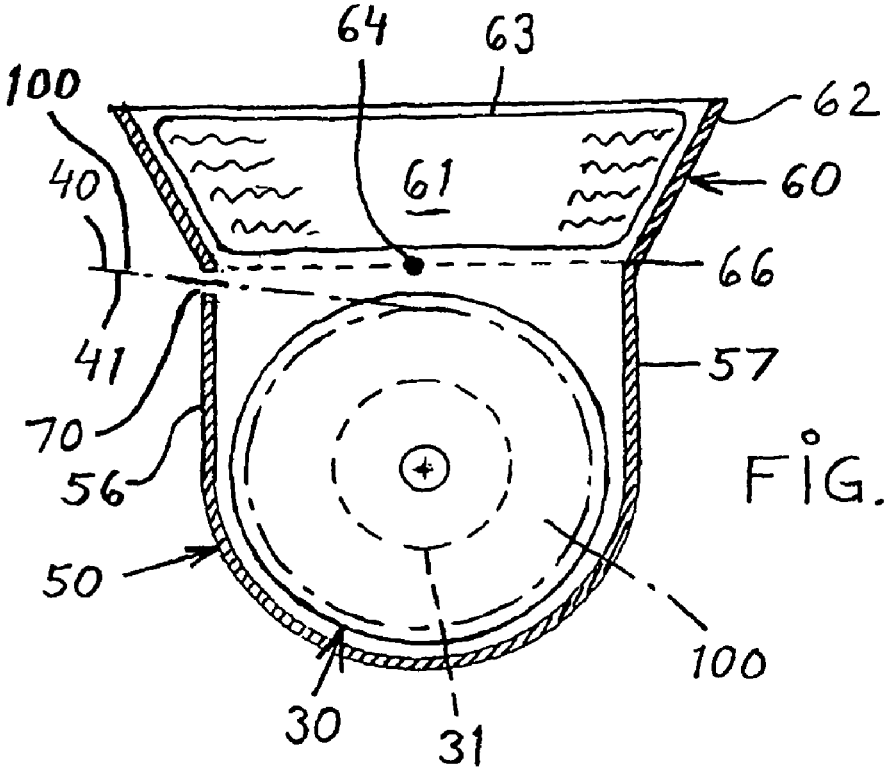
Figure 3:
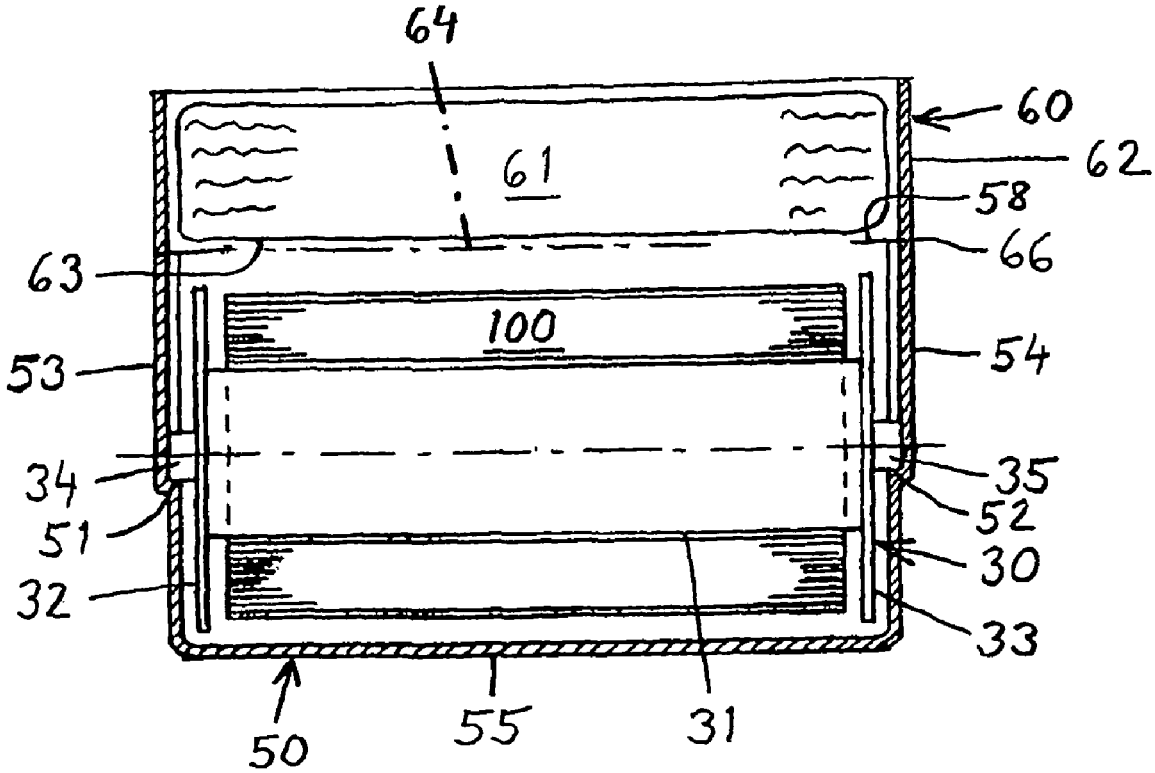

The invention will now be described in more detail with reference to an exemplifying embodiment thereof and also with reference to the accompanying drawings, in which FIG. 1 is a schematic vertical sectioned view of a valuable document accommodating cabinet equipped with inventive destructive devices;

FIG. 2 is a broken-away side view which illustrates the destructive devices schematically in larger scale; and FIG. 3 is a longitudinally sectioned view of a schematically illustrated destructive device.

DETAILED DESCRIPTION OF THE INVENTION

FIG. 1 illustrates a valuable item accommodating space or cabinet 1 that includes a protective shell or outer casing 2 which is adapted to detect/indicate an attempt to break into the space/cabinet 1.

Housed in the space 1 is a number of storage units 10-13 each of which is intended to house a plurality of valuable documents, such as banknotes 100. The shell-protected space 1 also houses a processor 20, which is continually informed of the availability of valuable documents in the storage units 10-13. The shell-protected space 1 also houses a transporter 21 which functions to transport valuable documents to their intended units 10-13, wherewith banknotes of one given denomination are fed to and/or from a specific storage unit, for instance. The item transport paths 22 are indicated by arrowed lines in FIG. 1. The shell-protected space 1 also houses an alarm device 23 which is equipped to detect a burglary attempt and different types of manipulative interference brought to bear on the space or cabinet 1 and its contents. As will be understood, when the cabinet or space 1 functions as a dispensing machine and/or deposit machine, the cabinet 1 will also include the requisite devices for these purposes.

The storage units 10-13 have the following construction. Each storing unit comprises a valuable document carrier in the form of a rotatable drum 30 that includes a cylindrical central part 31 and end-walls 32,33. The drum 30 includes a drive means in the form, e.g., of an electric motor, such as a reversible stepping motor (not shown), and end-journals 34, 35 for mounting the drum 30 for rotation relative to its surroundings. The valuable documents concerned are wound onto the drum 30 with the aid of carrier film or foil 40,41 which is conveniently disposed on reversibly rotatable rollers 42,43. Guide rollers 44-46 are provided for necessary guiding of the carrier films 40,41, as will be seen from FIG. 1. The banknotes 100 are fed-in between the carrier films 40,41, as indicated by arrows 25. Banknotes are dispensed from the drum 30, by reversing the direction of rotation of the drum 30 and also of the rollers 42-46. It will be understood, of course, that the illustrated carrier film arrangement can be varied in many different ways, and that it is also possible to use only one single carrier film provided that adhesion of the banknotes/valuable documents to the carrier film is ensured at the same time. When necessary, the carrier film/carrier foil may be perforated and/or profiled in one way or another. The processor 20 exercises and/or monitors the control of the storage units 10-13, so as to ensure that banknotes of relevant denominations are delivered to and removed from the drum 30 concerned, and also receives continuously information concerning the number of banknotes/valuable documents that are found on respective drums 30 at that moment in time.

According to the present invention, the drum 30 is placed in a tub or a collecting vessel 50, wherewith the drum 30 is mounted for rotation in the vessel 50 at bearing points 51,52 between the end journals 34,35 of the drum and the end-walls 53,54 of said vessel. The bottom part 55 of the vessel 50 conforms essentially shape-wise with the outer shape of the banknote-carrying drum 30, with a relatively small clearance therebetween, as evident from FIGS. 2 and 3. The side edges 56,57 of the vessels 50 are generally vertical, so as to enable the drum 30 to be lowered to its in-use position when fitting the drum to the vessel. The vessel 50 and also other devices provided in the cabinet 1 are, of course, supported by effective supportive structures (not shown).

A destructive medium container 60 is located above the vessel 50. The container 60 includes an outer container 62 which connects with the upper edge 58 of the vessel 50 such that a destructive agent 61, for instance a staining pigment or colour, will be able to run down into the vessel 50 at least generally without spillage, and therewith pour over the valuable documents/banknotes 100 in the drum 30 therewith effectively staining said items. The transition/junction 66 between the container 60 and the vessel 50 may include an appropriate seal (not shown). Alternatively, the container 60, which is removably fitted to the vessel 50, may have a smaller measurement in relation to the top opening of the vessel 50, so as to ensure the transfer of liquid in the absence of spillage. The container 60 thus houses the destructive agent 61, which is encapsulated in an inner container in the form of a foil casing 63, for example, wherein the outer container 62 will, of course, be adapted to provide the necessary support for the foil casing 63.

The container 60 also includes means for puncturing the casing 63 when necessary, so that its destructive substance content 61 is able to douse the drum 30 and run into the vessel 50. The puncturing device may have one of many different forms, for example the form of a movable cutter that will slit the casing 63 when activated. The casing 63 may alternatively be punctured with the aid of a tear impression, a weakening or the like which is caused to burst when the casing 63 shall be opened. A mechanical puncturing device 64 is indicated in FIGS. 2 and 3. It will be understood, however, that many different types of puncturing device can be used within the scope of the invention. For example, the casing 63 may be punctured by means of an electric heating wire. One or more remotely controlled release valves may also be used to this end.

A slot 70 is provided in the upper part of the vessel 50 or in the region 66 of the junction between the vessel 50 and the container 60, so as to enable the foil strip 40,41 and the valuable documents 100 to move to and from the drum 30 in the manner desired. When necessary, the slot 70 may be provided with a sealing means (not shown). The placement of the guide roller 46 determines the placement of the slot 70, meaning of course, that numerous variations are possible.

The volume of destructive agents 61 is conveniently chosen so that the vessel 50 will be filled adequately in response to activation of the alarm, although without the risk of the agent overflowing, even when the drum 30 carries the maximum number of banknotes/valuable documents 100.

The alarm unit/alarm device 23 communicates with a number of alarm sensors or devices that indicate different types of burglary attempts and/or manipulative action. A non-limiting example of suitable indications is when a burglary attempt is made by breaking open or perforating the protective shell 2, bursting the space or cabinet 1 apart, illegal withdrawal of banknotes by different manipulating processes, temperature attacks, and so on. The arrangement may also include one or more tilt sensors adapted to initialise triggering of an alarm if an attempt is made to tilt the valuable item storage space.

The alarm device 23 also communicates with the processor 20.

The following events take place when an alarm is triggered.

When a burglary attempt or some other unlawful attack/manipulation is registered by the alarm device 23, said device initialises together with the processor 20 triggering of a destructive agent 61 in those storage units 10-13 that on this occasion contain valuable documents/banknotes 100. The destructive agent 61 is released by activation of the puncturing means 64 which punctures or opens the casing 63 so that destructive agent 61 will douse the drums 30 and the banknotes 100 wound thereon, as said agent runs into the collecting vessel 50, said vessel being filled by said destructive agent to a large extent. The banknotes are therewith stained or destroyed in some other way, so as to render them useless as a means of payment. Because the released destructive agent is collected in the vessel 50, the restoration means necessary when the cabinet 1 shall later be restored to its original state are minimised. The restoration requirement is also minimised by virtue of the fact that the processor 20, which is continuously informed of the quantity of banknotes on each drum 30, will only permit the release of destructive agent in those storage units where the need for destruction exists at the time at which activation of staining of the drum-carried banknotes is required, for instance.

It will be understood that structural solutions in conjunction with the present invention can be varied in many different ways within the scope of the inventive concept.

Mounting of the rotational drive of the drum 30 inside the collecting vessel 50 eliminates the need for a sealing transit at the point of connection of the drive means with the drum 30.

The vessel 50 may be made of a plastic material, for instance injection moulded and therewith be constructed for good connection with the drum 30 and its surrounding components.

The volume of the destructive agent may, of course, be varied as required, although it is normally convenient for the destructive agent to at least fill the vessel up to the level of the centre axis of the drum.

The efficiency of the destructive agent can be enhanced, when necessary, by causing the drum to rotate during the process of destruction.

When desiring to use a two-component or multi-component destructive agent, there is used a corresponding number of casings/containers 63 and puncturing means.

When desiring a more aggressive distribution of destructive agent, an explosive substance can be used to puncture and/or expel destructive agent from the casing or container. In this regard, however, it is necessary to ensure that a sealing lid or like covering means is provided on top of the container 60.

As will be understood, the destructive device is activated when the drum 30 is rotated in a dispensing direction such that banknotes/valuable documents will leave the drum in the absence of legal instructions. The number of criteria required to trigger the destructive agent may, of course, be adapted to prevailing practical requirements.

Further structural modifications are, of course, possible within the scope of the inventive concept. For example, the design of the container 60 and the destructive agent arrangement may be varied in many different ways. The outer container 62 and the inner container 63 may, of course, be integrated with one another so as to form constructively a single unit, and so on.

As will be understood, it is possible to provide valuable item storage spaces or cabinets that include solely one single storage unit, which may be the case when the drum or item collecting device houses a mixture of banknote denominations.

The design and construction of the means for collecting said valuable documents may also be varied within the scope of the invention, as can also the arrangement for feeding valuable documents to and from said collecting means.

It will also be noted that the alarm device and/or the processor may be placed outside the valuable item storage space/cabinet, provided that their communication with said cabinet can be safely ensured. The arrangement of the sensors of the alarm device will, of course, be adapted to prevailing requirements, for instance pressure sensors, motion sensors, tilting sensors/inclination sensors, temperature sensors, smoke sensors, and the like can be used. Alarm levels may also be varied.

It will be noted that the drum walls 32 and 33 are preferably perforated so as to enhance staining/destruction of the valuable documents.

The foils 40 and 41 normally provide capillary-like absorption of destructive agent by the drum-wound valuable documents, meaning that a relative small amount of destructive agent often will be sufficient in achieving a satisfactory destruction result. For example, the destruction result will most often be satisfactory even at relatively low liquid levels/destructive agent levels in the collection vessel 50.

The invention is thus not restricted to the described and illustrated embodiments, since modifications and variations are conceivable within the scope of the accompanying Claims.

The invention claimed is:

1. A method for destroying valuable documents, including bank notes, stored within a main housing having a plurality of storage spaces in the event of an attempt to gain access to said valuable documents without proper authorization, each of said plurality of storage spaces housing a single drum, a single collecting vessel, and a single destructive agent container; the steps of said method including:

storing said valuable documents in said plurality of storage spaces housing a single drum (30);

winding said documents on or off said drum with the aid of a carrier film or foil (40,41);

housing said drum (30), at least partially, within a single collecting vessel (50) within each of said plurality of storage spaces;

providing a single destructive agent container (60,63) containing a destructive agent in fluid communication with said single collecting vessel within each of said plurality of storage spaces;

generating an alarm signal in response to an unauthorized attempt to access said valuable documents; and applying said destructive agent from said destructive agent container into said collecting vessel and onto the valuable documents wound on said drum in each of said plurality of storage spaces with the aid of said carrier film or foil in response to said alarm signal.

2. A method according to claim 1, including the step of using a volume of said destructive agent (61) that can be handled by the collecting vessel (50) in the absence of overflow.

3. A method according to claim 1, including the step of placing the destructive agent container (60, 63) above the collecting vessel (50) so that the destructive agent (61) will run or fall down into the collecting vessel when said alarm signal is generated.

4. A method according to claim 1, including the step of causing said destructive agent container (63) to be punctured by means of a puncturing device (64) in response to said alarm signal.

5. A method according to claim 1, including the step of subjecting only said drum (30) that contains said valuable documents in each of said plurality of storage spaces to said destructive agent in response to said alarm signal.

6. The use of a method according to claim 1, charcterised by applying the method in cash dispensers, depositing machines, and automatic teller machines.

7. A method according to claim 2, including the step of placing the destructive agent container (60, 63) above the collecting vessel (50) in each of said plurality of storage spaces so that the destructive agent (61) will run or fall down into the collecting vessel when said alarm signal is generated.

8. The use of a method according to claim 2, charcterised by applying the method in cash dispensers, depositing machines, and automatic teller machines.

9. The use of a method according to claim 3, charcterised by applying the method in cash dispensers, depositing machines, and automatic teller machines.

10. The use of a method according to claim 4, charcterised by applying the method in cash dispensers, depositing machines, and automatic teller machines.

11. The use of a method according to claim 5, charcterised by applying the method in cash dispensers, depositing machines, and automatic teller machines.

12. An arrangement for destroying valuable documents, including banknotes, stored within a main housing having a plurality of storage spaces; each of said plurality of storage spaces housing a single drum, a single collecting vessel, and a single destructive agent container; said arrangement including a single drum (30) within each of said plurality of storage spaces for storing said valuable documents, said valuable documents being wound on said drum with the aid of a carrier film or foil;

a single collecting vessel for housing, at least in part, said drum within each of said plurality of storage spaces;

a single destructive agent container in fluid communication with said collecting vessel within each of said plurality of storage spaces;

an alarm for detecting and generating an alarm signal in response to an attempted unauthorized access to said valuable documents; and means for applying a destructive agent contained within said destructive agent container in each of said plurality of storage spaces into said collecting vessel in each of said plurality of storage spaces and onto said valuable documents wound on said drum in each of said plurality of storage spaces in response to said alarm signal.

13. An arrangement according to claim 12, characterised in that in each of said plurality of storage spaces, said destructive agent container (60, 63) is arranged above a top opening of the collecting vessel (50).

14. An arrangement according to claim 12, characterised in that in each of said plurality of storage spaces for storing said valuable documents (100), said drum (30) is rotatably mounted in the collecting vessel (50).

15. An arrangement according to claim 12, characterized in that said arrangement includes an alarm-controlled puncturing means (64) that functions to release the destructive agent (61) in response to said alarm signal.

16. The use of an arrangement according to claim 12, charcterised by using the arrangement in cash dispensers, depositing machines, and automatic teller machines.

17. An arrangement according to claim 13, characterised in that in each of said plurality of storage spaces for storing said valuable documents (100), said drum (30) is rotatably mounted in the collecting vessel (50).

18. The use of an arrangement according to claim 13, charcterised by using the arrangement in cash dispensers, depositing machines, and automatic teller machines.

19. The use of an arrangement according to claim 14, charcterised by using the arrangement in cash dispensers, depositing machines, and automatic teller machines.

20. The use of an arrangement according to claim 15, charcterised by using the arrangement in cash dispensers, depositing machines, and automatic teller machines.

* * * * *